US011459063B2

(12) United States Patent
Langlois

(10) Patent No.: US 11,459,063 B2
(45) Date of Patent: Oct. 4, 2022

(54) SYSTEM AND METHOD OF A MODIFIED TRIM TAB SYSTEM WITH FLUID HINGE FOR VARIABLE-TRANSOM WATERCRAFTS

(71) Applicant: Joseph R. Langlois, Pompano Beach, FL (US)

(72) Inventor: Joseph R. Langlois, Pompano Beach, FL (US)

( * ) Notice: Subject to any disclaimer, the term of this patent is extended or adjusted under 35 U.S.C. 154(b) by 16 days.

(21) Appl. No.: 17/306,595

(22) Filed: May 3, 2021

(65) Prior Publication Data

US 2021/0316818 A1 Oct. 14, 2021

Related U.S. Application Data

(63) Continuation-in-part of application No. 16/432,393, filed on Jun. 5, 2019, now Pat. No. 10,994,807, and a continuation-in-part of application No. 15/617,365, filed on Jun. 8, 2017, now Pat. No. 10,315,737, and a continuation-in-part of application No. 14/997,244, filed on Jan. 15, 2016, now abandoned.

(51) Int. Cl.
*B63B 1/24* (2020.01)
*B63B 73/40* (2020.01)

(52) U.S. Cl.
CPC ..... *B63B 1/242* (2013.01); *B63B 73/40* (2020.01)

(58) Field of Classification Search
CPC ..... B63B 1/242; B63B 73/40
See application file for complete search history.

(56) References Cited

U.S. PATENT DOCUMENTS

2021/0316818 A1* 10/2021 Langlois ..... B63B 39/061
2021/0371059 A1* 12/2021 Langlois ..... B63B 39/061

* cited by examiner

*Primary Examiner* — S. Joseph Morano
*Assistant Examiner* — Jovon E Hayes
(74) *Attorney, Agent, or Firm* — Melvin K. Silverman

(57) ABSTRACT

A system and method of configuration including a trim tab having a planar surface, and guiding tabs coupled to the trim tab. The guiding tabs extend outward. A pair of mounting brackets, with a mounting plate, a vertical leg, and a safety catch tab are included. The mounting brackets are configurable for variable mounting. The vertical leg of the mounting bracket includes an upper portion bottom portion, the vertical leg bottom portion is vertical, and the upper portion is configurable to be angulated relative to a transom. The upper portion and mounting bracket have an angle between, which may be adjusted relative to a curvature in the transom. The guiding tabs configured to engage with the vertical legs of the mounting bracket, wherein the trim tabs are located forward of the vertical legs of the mounting brackets.

7 Claims, 11 Drawing Sheets

SYSTEM AND METHOD OF A MODIFIED TRIM TAB SYSTEM WITH FLUID HINGE FOR VARIABLE-TRANSOM WATERCRAFTS

CROSS REFERENCE TO RELATED APPLICATIONS

The application is a continuation-in-part of application Ser. No. 16/432,393 filed Jun. 5, 2019, which is a continuation-in part of patent application Ser. No. 15/617,365, filed Jun. 8, 2017, which is a continuation-in-part of patent application Ser. No. 14/997,244, filed on Jan. 15, 2016, now abandoned. All prior related patents and patent applications are herein incorporated by reference in their entirety.

FIELD OF THE INVENTION

The present invention relates to an improvement in classical trim-tab technology to enhance the general hydrodynamic performance of a marine craft inclusive of the fuel efficiency thereof.

BACKGROUND OF THE INVENTION

So-called boat leveling devices of the trim-tab type have been known for many years and various forms of them have been developed in an effort to maximize attitude control, stability of the marine craft and general hydrodynamic efficiency inclusive of decrease of flow velocity under the hull and fuel efficiency.

It is known in the art to provide a trim-tab with a physical coupling takes place at the hinging point between the flat surface of the trim-tab and the hull of a watercraft to which it attaches. This physical coupling has come in the form of a pivoting hinge, or in the form of a living hinge.

The prior art, Arnseson U.S. Pat. No. 4,909,175, demonstrates the hinge common in most trim tabs, that is, a pivot hinge that fastens the planar surface of the trim tab to the watercraft. The pivot hinge is fixed in a specific location, and requires an actuator, mounted at an non-right angle to allow the planar surface to descend.

The prior art, Weiler, U.S. Pat. No. 3,463,109, shows a similar issue where the planar surface is fastened directly to the hull of the watercraft by a living hinge. This living hinge is in a fixed location as well, and thus requires an actuator mounted at a non-right angle, or the actuator with a pivot mount to allow the planar surface of the trim tab to descend.

There are significant differences between the prior art and the current invention. Primarily, the use of a living hinge as in the prior art of Arnseson U.S. Pat. No. 4,909,175 and Weiler, U.S. Pat. No. 3,463,109, do not allow an extent of slidability for the trim tabs it connects. Arnseson uses a living hinge, which is a thin flexible hinge made from the same material as the two rigid pieces it connects. Weiler uses a pivot hinge, which allows its trim tab to raise and lower, but is limited to pivoting around its connection point. Thus, there exists a need for a fluid-hinge to allow slidability of the trim tab it connects.

These hinges in the prior art make changing a trim tab a difficult task. If a trim tab is damaged, or needs to be replaced, the operator removing the tab may further cause damage or destroy the trim-tab, as well as damage the hull of the watercraft it attaches to.

Further, an aspect that is prevalent in the prior art is the need to drill into the bottom surface of the hull of the watercraft. Not only is it a very precise process to tap holes into the bottom surface of the hull, but it requires sufficiently strong sealant to create buffers between the inside of the hull and the water. The present invention eliminates the need to drill holes in the bottom surface of the hull of a watercraft.

However, in my previous applications, an issue arises when an installer attempts to attach the trim tab system to the transom of a watercraft, because many watercrafts include sloped, curved, and otherwise non-linear transoms. Thus, the system of that application may require an installer to use long bolts and fill in any gaps with resin when mounting. This addition of resin increases the price of the system. The present invention eliminates this issue, allowing for a more cost effective installation.

The present inventor has obtained patents in the general area of marine technology, such as U.S. Pat. Nos. 10,035,571 B1, and 10,005,527 B2.

SUMMARY OF THE INVENTION

The invention provides a system for a transom-mount trim tab system with a fluid hinge. The system includes a trim tab having a planar surface, and guiding tabs coupled to the trim tab, wherein the guiding tabs extend outward toward a port side and a starboard side The trim tab has a forward section located under a hull of a watercraft and an rear portion extending aft of a transom, whereby mounting means may engage with the trim tab to raise and lower the trim tab. The mounting means including a pair of mounting brackets, each with a mounting plate, and a vertical leg, and a safety catch tab. The mounting brackets are configurable for variable mounting, wherein the vertical leg of the mounting bracket includes a vertical leg upper portion and a vertical leg bottom portion, the vertical leg bottom portion in a vertical orientation, and the vertical leg upper portion is configurable to be angulated relative to a transom of a watercraft. The upper portion of the vertical leg and the mounting bracket have a configurable angle there-between, wherein the angle may be enlarged or reduced resulting in an adjustment relative to a curvature in the transom of a watercraft. The trim guiding tabs configured to engage with the vertical legs of the mounting bracket, wherein the trim tabs are located forward of the vertical legs of the mounting brackets.

The instant invention further provides a method for configuring a system for a transom-mount trim tab system with a fluid hinge. The method includes using a flat board with borders of the flat board mirroring a set of dimensions of a trim tab to be mounted, lining the flat board up in a bow to stern orientation in the approximate final mounting location of the trim tab to be mounted, temporarily mounting the under a bottom surface of a hull of a watercraft, wherein the temporary mounting is accomplished through use of an expanding stand to press the board against the bottom surface under the hull of a watercraft, marking an outline of a transom boundary of the transom on to the flat board to obtain a template for a guide plate, providing a trim tab system, of the type recited above, configuring the guide plate to dimensions of the template, wherein the guiding tabs are placed at a location just under the boundary of the transom to thereby guide the trim tabs when engaged with the pair of vertical legs of the mounting bracket, configuring the upper portion of the vertical legs to match an angulation of the transom, the lower legs remaining vertical, configuring the mounting plate of the mounting bracket the angulation of the transom, and mounting the trim tab system to the transom of the watercraft.

It is accordingly an object of the present invention to provide an improved trim tab system which overcomes the various hydrodynamic limitations of the prior art, the same having utility with leisure as well as naval vessels.

It is also accordingly an object of the invention to eliminate any drilling or tapping into the bottom surface of the hull of a watercraft to secure the planar surface.

The present invention also seeks to increase efficiency of removing and replacing a trim tab, for various reasons including replacement and cleaning, by allowing the user to disconnect the actuator from the trim tab, and slide the trim tab out of the capture of the fluid hinge, and thereby lessoning time-consumption and damage to the watercraft or trim tab due to removal as a result.

It is additionally an objective of the current invention to provide a mounting system and method for various transom shapes, including curved and sloped transoms.

The above and yet other objects and advantages of the present invention will become apparent from the hereinafter set forth Brief Description of the Drawings, Detailed Description of the Invention and Claims appended herewith.

DETAILED DESCRIPTION OF THE INVENTION

Figure 1:
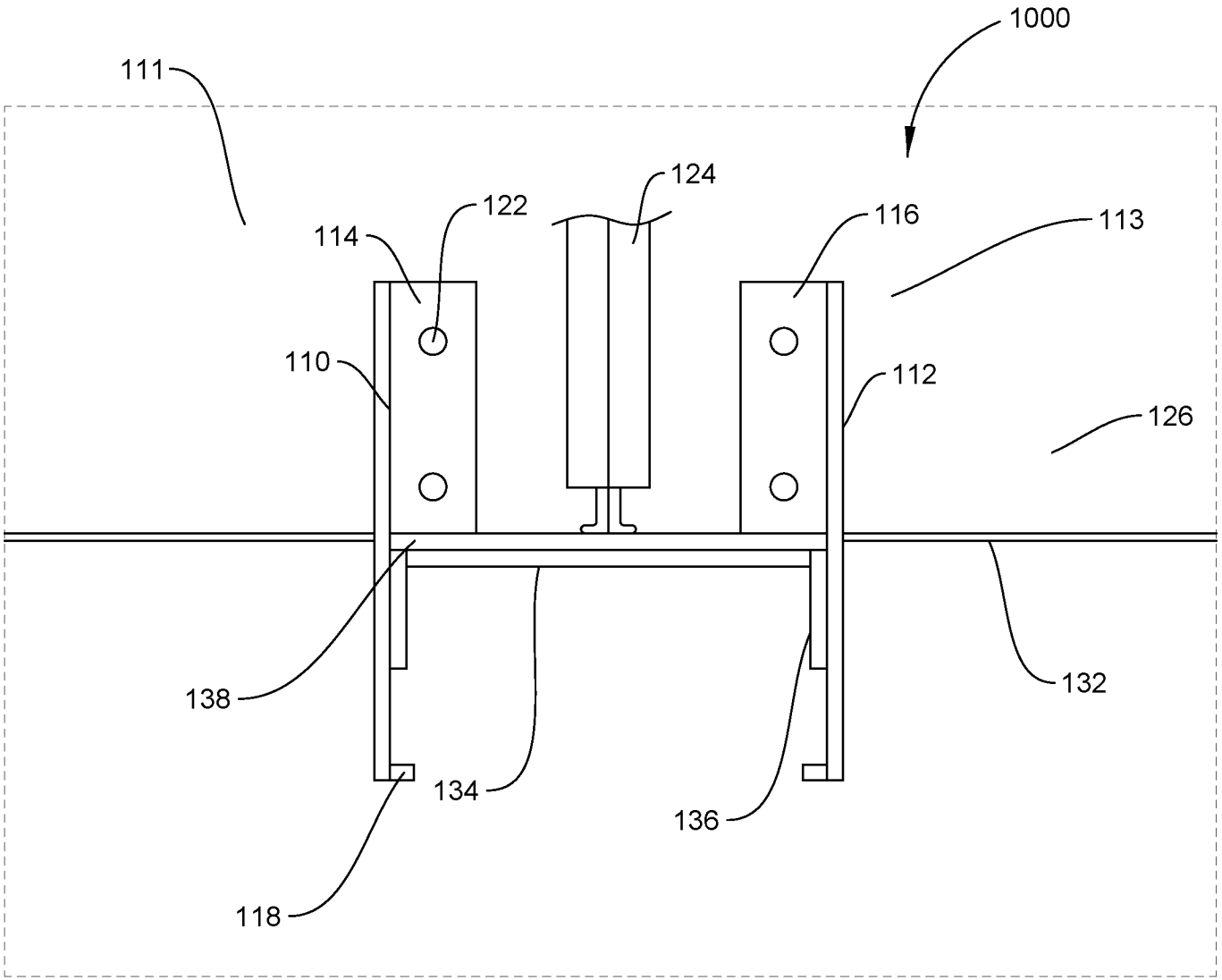
FIG. 1 shows an isolated elevation view of a transom mounted trim tab system.

Most transoms are curved rather than straight up and down. When mounting trim tab systems that include a fluid hinge, any mounting brackets that are planar require long bolts and a filling material, such as resin, to fill in the gaps. The current system overcomes these issues, and in doing so, results in a more cost effective solution. Although the current invention requires additional time for welding and bending the metal in the brackets, the customized configurations reduce extra expenses for filler material, thereby reducing the overall cost.

The current system is shown in FIGS. 1-10B. It utilizes trim tab design utilizing a fluid hinge, which indicates that the trim tab 134 may move and slide, but function as a trim tab 134 without the necessity for a fixed connection or hinged connection associated with typical trim tab. However, with the use of a fluid hinge, the forces pushing against the trim tab 134 need to be supported by a bracket 111/113 so that the forces do not overwhelm or damage the actuator 124 on the trim tab 134.

As may be seen in FIGS. 1-10B, a pair of brackets 111/113 have been added to each trim tab system, one on a port side of the trim tab 134, and one on a starboard side. The brackets include a mounting plate 114/116 with apertures 122 for bolts to mount the brackets 111/113. Attached to the mounting plate 114/116 is a vertical leg 110/112, which may be separated in to a top 172 and a bottom 174 portion, as may be seen in FIG. 7B, wherein the angulation between the mounting plates 176 and the vertical leg 172/174 may be angulated depending on the curvature 128 of the transom 126, as may be seen in FIG. 3. Further, the top 172 and bottom 174 portion may also be angulated to keep the bottom portion 174 of the vertical legs in an always vertical orientation for engagement with the trim tabs 134. To prevent the rear of the trim tab 134 from descending too far down, each bracket 111/113 has a safety catch tab 118/120 to act as a barrier to catch overly lowered trim tabs 134. Because these brackets 111/113 descend below the bottom surface 132 of the hull 130 of the watercraft, a degree of drag will be present. Rounded forward edges 170 have been included to reduce this drag, as may be appreciated from FIGS. 6A and 6B.

To assist the brackets in transferring excess force from the trim tabs 134, is a guide plate 138 affixed to each trim tab 134, as may be appreciated in FIGS. 1-4 and 8A-9. The guide plate 138 also has a pair of guide tabs 140/142 on either side, wherein the guide tabs 140/142 press against the vertical legs 110/112 of the mounting brackets 111/113 to keep the trim tab 134 from shifting too far backward. In most cases, the guide tabs 140/142 are configured at different positions, as may be appreciated in FIGS. 8A-8C, in a front to back orientation of the trim tabs 134 because the brackets 111/113 will be mounted on a curved or sloped transom 126 and will need to engage at different points on the trim tab 134.

Because the trim tab 134 may shift forward during watercraft reverse, in addition to the fluid hinge system, a forward trim tab safety catch 162 is included to contain the forward portion of the trim tab 134 from falling out of connection.

FIG. 1 shows an isolated elevation view of a transom mounted trim tab system 1000. As may be seen, the figure shows the left and right mounting brackets 111/113, comprising the vertical legs 110/112, safety catch tab 118, mounting plates 114/116, including apertures 122 therein. The guiding plate 138 may also be seen attached to the trim tab 134, wherein the shown embodiment also has sidewalls 136 for the trim tab 134, wherein the sidewalls help channel water under the trim tab 134. FIG. 1 also shows the system 1000 relative to the transom 126 of the watercraft, and the relative to the bottom surface 132 of the hull.

Figure 2:
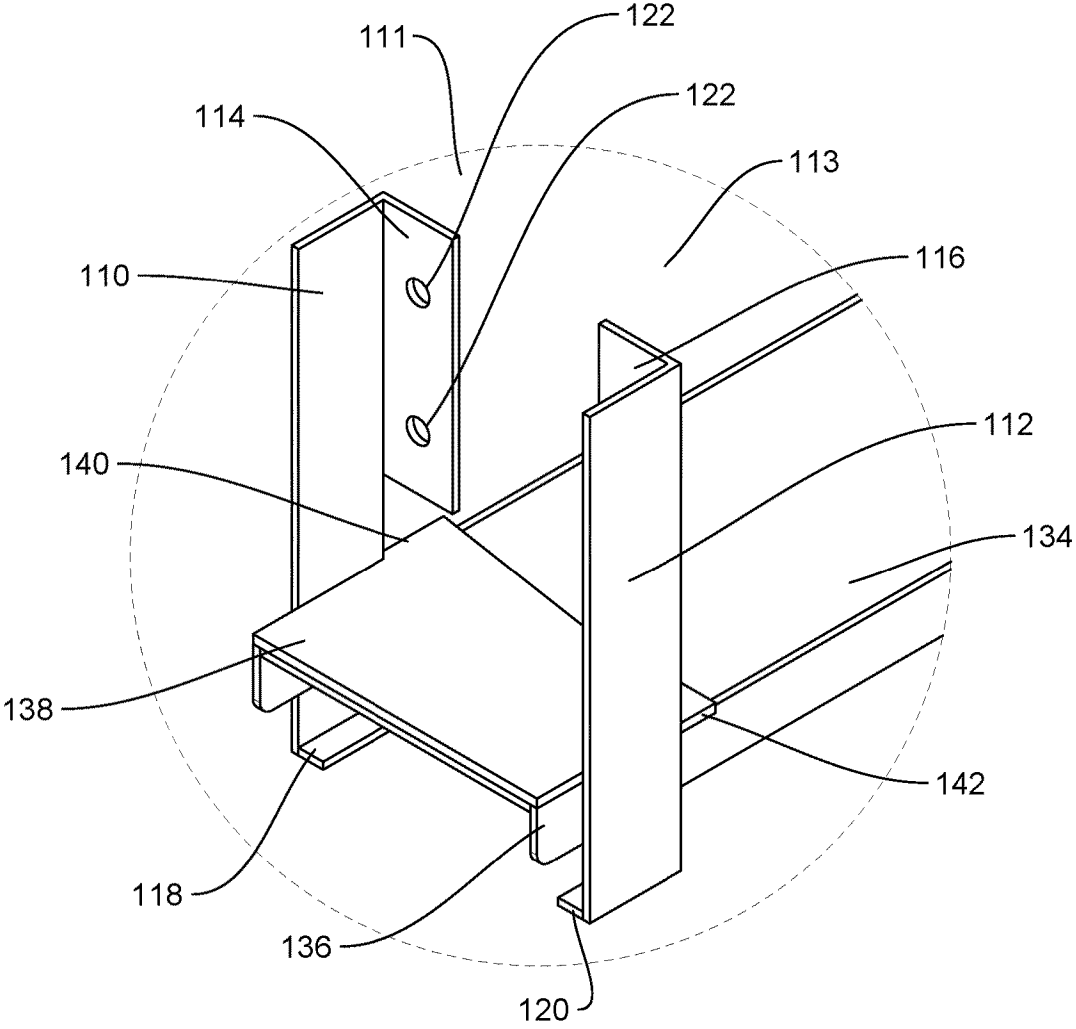
FIG. 2 shows an isometric view of the trim tab with mounting brackets.

FIG. 2 shows an isometric view of the system 1000 with trim tab 134 with mounting brackets 111/113. FIG. 22 focuses on the core elements of novelty, including the guiding plate 138 coupled to the trim tab 134, wherein the guiding tabs 140/142 may be seen engaging with the vertical legs 110/112 of the brackets 111/113, to thereby receive the force of thrust against the trim tab 134. The mounting brackets 114/116 are also shown, wherein apertures 122 may be appreciated for mounting the brackets to a transom (not shown in FIG. 2). As may be additionally appreciated in FIG. 2, safety catch tabs 118/120 may be seen in an orientation which shoes the extension beyond the sidewalls 136 of the trim tab 134, wherein the safety catch tabs 118/120 will allow the sidewalls 136 to rest on the safety catch tabs 118/120 when the force of thrust is not pushing up on the trim tab 134.

Figure 3:
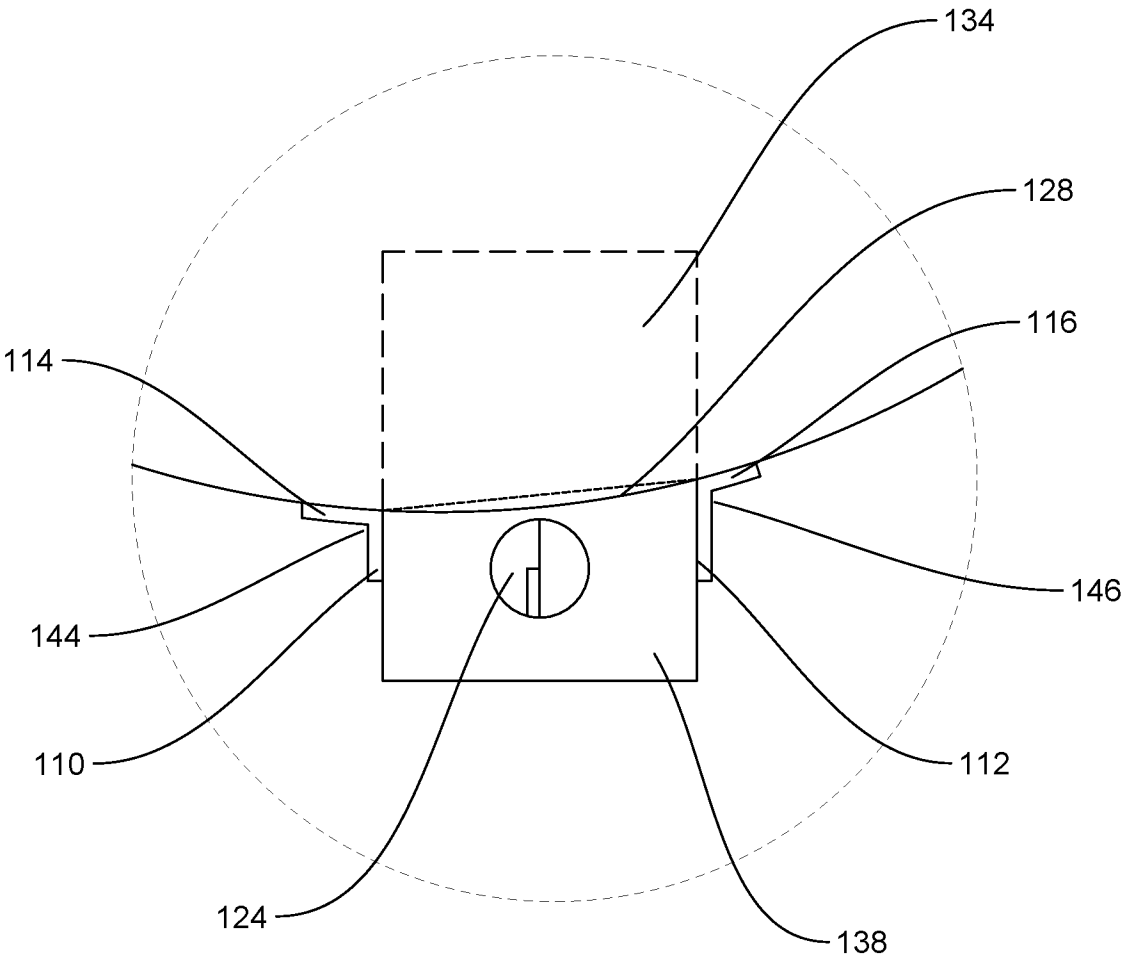
FIG. 3 is a top plan view of the trim tab of the system, with the entire trim tab shown in phantom.

FIG. 3 is a top plan view of the trim tab of the system 1000, with the entire trim tab 134 shown in phantom. The guiding plate 138 is seen protruding from the transom boundary 128 of the watercraft. The guiding plate can be seen to engage with the brackets with mounting plate 114/116 and vertical legs 110/112. The actuator 124 is also shown in FIG. 3. As may be appreciated from the top view, angulation 144 exists between the left mounting plate 114 and left vertical leg, wherein the angle depends on the curvature of the transom boundary 128. Similarly, angulation 146 is influenced by the right mounting plate 116 and right vertical leg 112. Because the transom boundary 128 is curved, the viewer should also appreciate that the guiding plate 138 will be configured to have guiding tabs (shown in FIGS. 8A-8C) that are located at different points along the trim tab 134, that is, the vertical leg will be mounted in a close proximity to mounting points along the curved transom, but the trim tabs will be in a front to back axial orientation, thus, the vertical legs will have to be mounted relative to different points along the trim tab 134. The guiding plate 138 helps keep these brackets engaged with the trim tab. Further, it may be appreciated that in some embodiments, the guiding tabs may be incorporated in to the trim tab itself without the use of a guiding plate 138 as shown, wherein the additional tabs may be considered the guiding plate without a physically separate piece of material, and such embodiments should be understood to be incorporated under the broadest reasonable interpretation of the claims.

Figure 4:
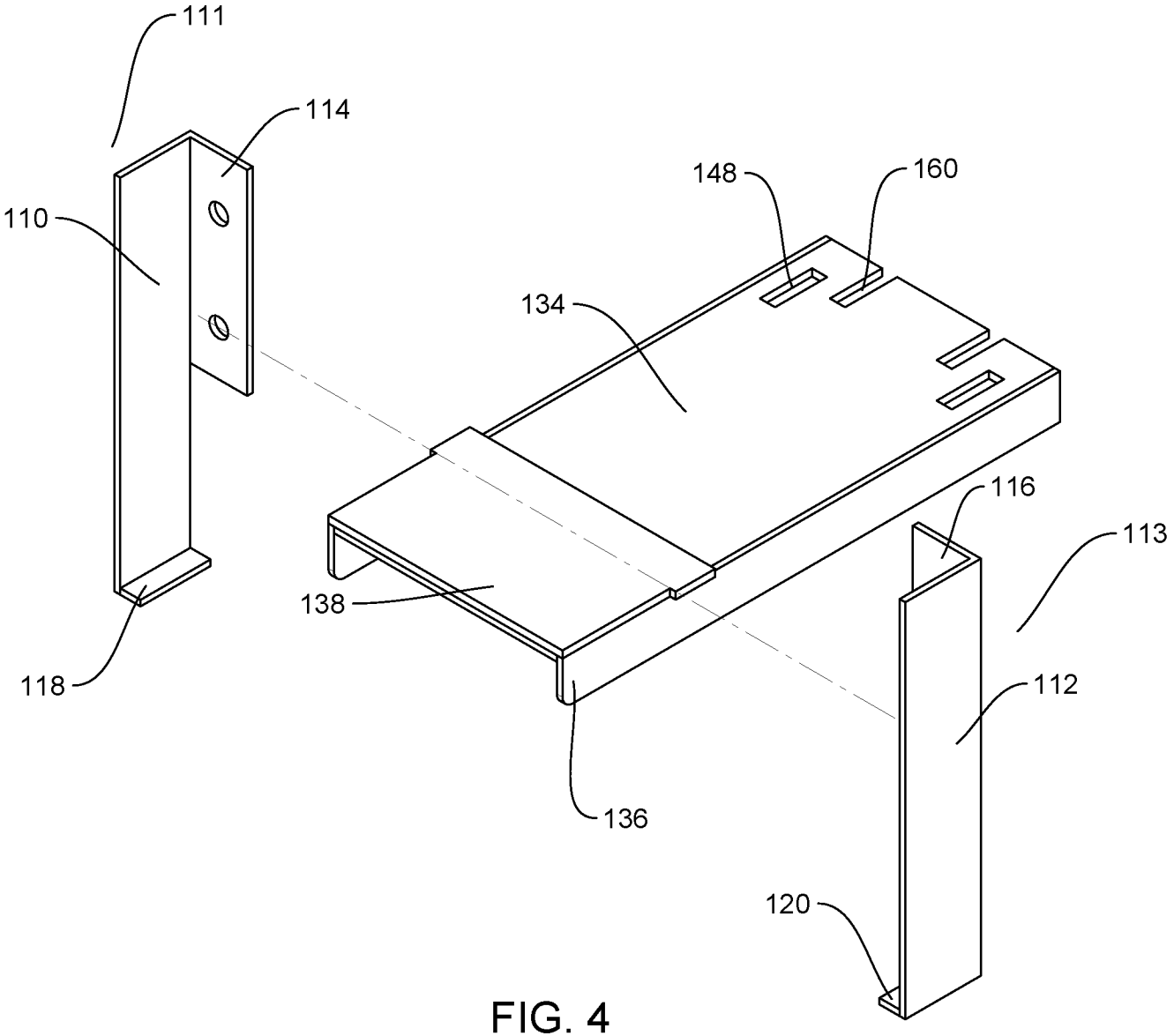
FIG. 4 is an exploded view of the trim tab system components of the trim tab, mounting brackets, and guide plate.

FIG. 4 is an exploded view of the trim tab system 1000 components of the trim tab 134, mounting brackets 111/113, and guide plate 138. The alignment may be seen from this view. Left mounting bracket 111 may be seen to include the vertical leg 110, mounting plate 114, and safety catch tab 118. Right mounting bracket 113 may be seen to include the vertical leg 112, mounting plate 116, and trim tab safety catch tab 120. The trim tab embodiment is shown to have sidewalls 136. Further, the front of the trim tab 134 in the figure shows the fluid hinge aperture 148, wherein a fluid hinge bracket 150 (shown in FIG. 10A) may engage. Also shown in FIG. 4 is the forward trim tab safety catch aperture 160, wherein the trim tab safety catch 162 (shown in FIG. 10B) may engage.

Figure 5B:
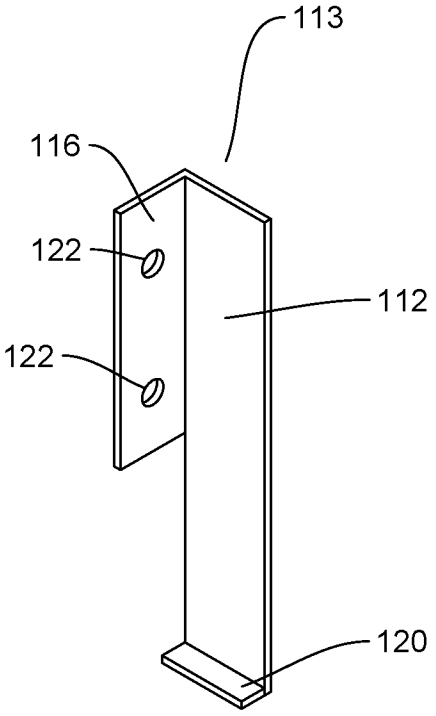
FIG. 5B is a perspective view of a right mounting bracket of the trim tab system.
Figure 5A:
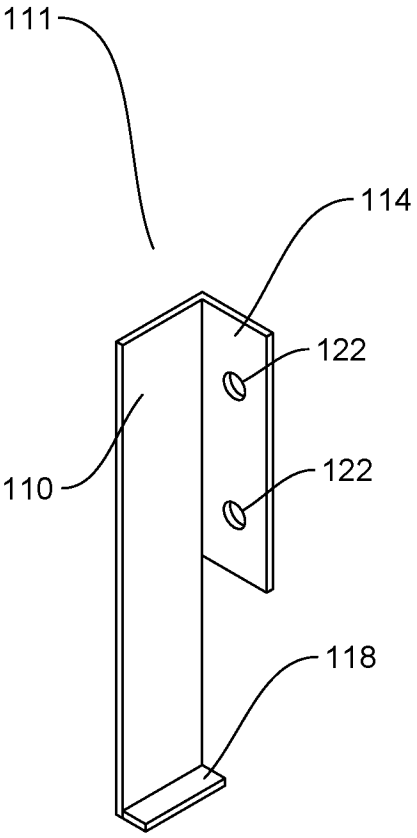
FIG. 5A is a perspective view of a left mounting bracket of the trim tab system.

FIG. 5A is a perspective view of a left mounting bracket 111 of the trim tab system 1000. The figure particularly points out the left mounting plate 114, left vertical leg 110, left safety catch tab 118, and mounting apertures 122. FIG. 5B is a perspective view of a right mounting bracket 113 of the trim tab system 1000. The figure particularly points out the right mounting plate 116, left vertical leg 112, left safety catch tab 120, and mounting apertures 122.

Figure 6B:
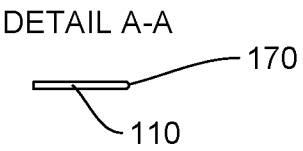
FIG. 6B is a top view of section cut A-A of the embodiment shown in FIG. 6A.
Figure 6A:
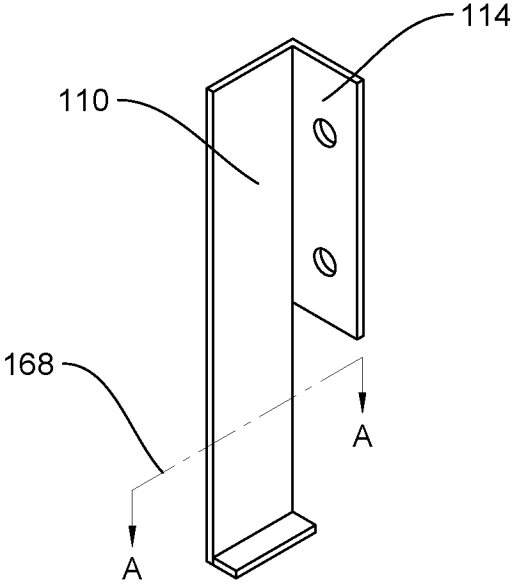
FIG. 6A is a view as shown in FIG. 5A, showing section cut A-A.

FIG. 6A is a view as shown in FIG. 5A, including the mounting plate 114 and vertical leg 110, but also showing section cut A-A 168. FIG. 6B is a top view of section cut A-A 168 of the embodiment shown in FIG. 6A. As may be appreciated, the front portion of the vertical leg 110 is a rounded edge 170, which helps reduce forces acting on the vertical leg, and increase hydrodynamic efficiency. Because the vertical legs 110 descent below the hull of the watercraft, it is important to optimize the surfaces to reduce drag on the system.

Figure 7B:
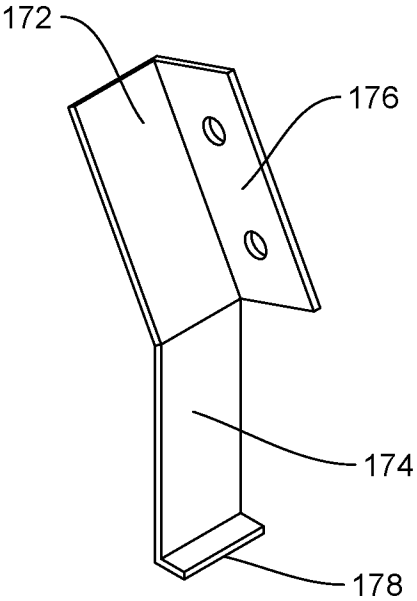
FIG. 7B is an alternative configuration of the bracket shown in FIG. 7B, configured to a warped or curved transom surface.
Figure 7A:
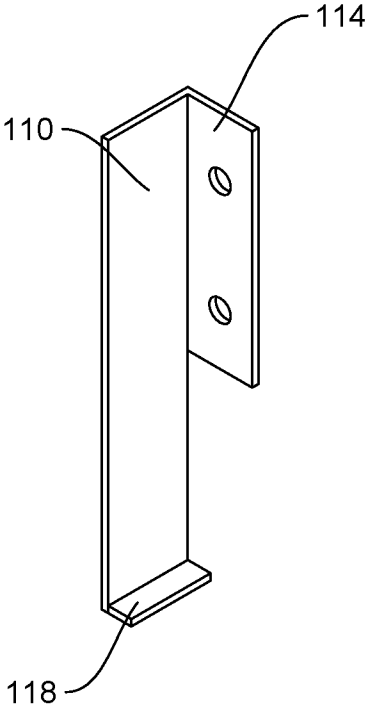
FIG. 7A is a perspective view of a left bracket of the system, as shown in FIGS. 5A and 6A.

FIG. 7A is a perspective view of a left bracket of the system, including mounting plate 114, vertical leg 110, and safety catch tab 118, as similarly shown in FIGS. 5A and 6A. FIG. 7B is an alternative configuration of the bracket shown in FIG. 7B, configured to a warped or curved transom surface. Because surfaces of a transom exist in a polar curvature (curving left and right as well as up and down), the brackets will likely not be strictly vertical, as shown in FIG. 7A. Thus, in many cases, the brackets will have a top portion 172 of the vertical leg and a bottom portion 174 of the vertical leg, wherein both may be angulated. The mounting plate 176 will also be angulated as well. FIG. 7B also shows the safety catch tab 178 for the angled embodiment of the brackets.

Figure 8A:
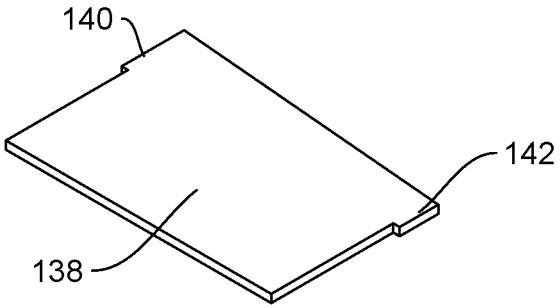
FIG. 8A is a perspective view of the guiding plate.
Figure 8C:
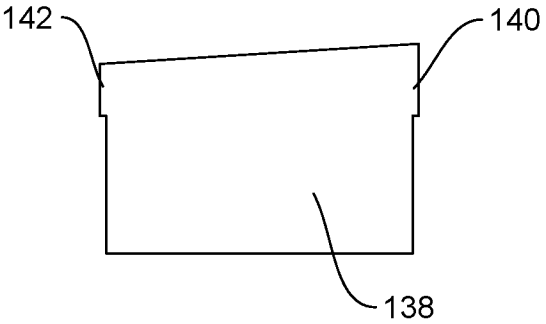
FIG. 8C is a top plan view of an alternative guide plate, similar to FIG. 8A, showing an off-axis orientation of the guiding tabs.
Figure 8B:
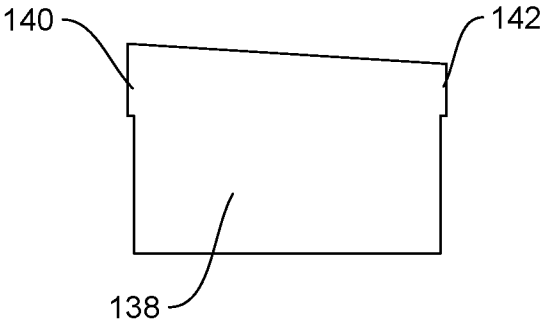
FIG. 8B is a top plan view of a guide plate showing an off-axis orientation of the guiding tabs.

FIGS. 8A, 8B, and 8C show the guiding plate 138 and associated guiding tabs 140/142. FIG. 8A is a perspective view, 8B is a top plan view, and 8C is an alternate plan view. As may be appreciated in the comparison of FIGS. 8B and 8C, the guiding tabs 140/142 are not equidistant from the end portion of the trim tab 134 (As may be seen in FIG. 9). That is because the brackets will likely be mounted in close proximity to a curved transom, wherein the curvature will skew where the brackets engage on the trim tab.

Figure 9:
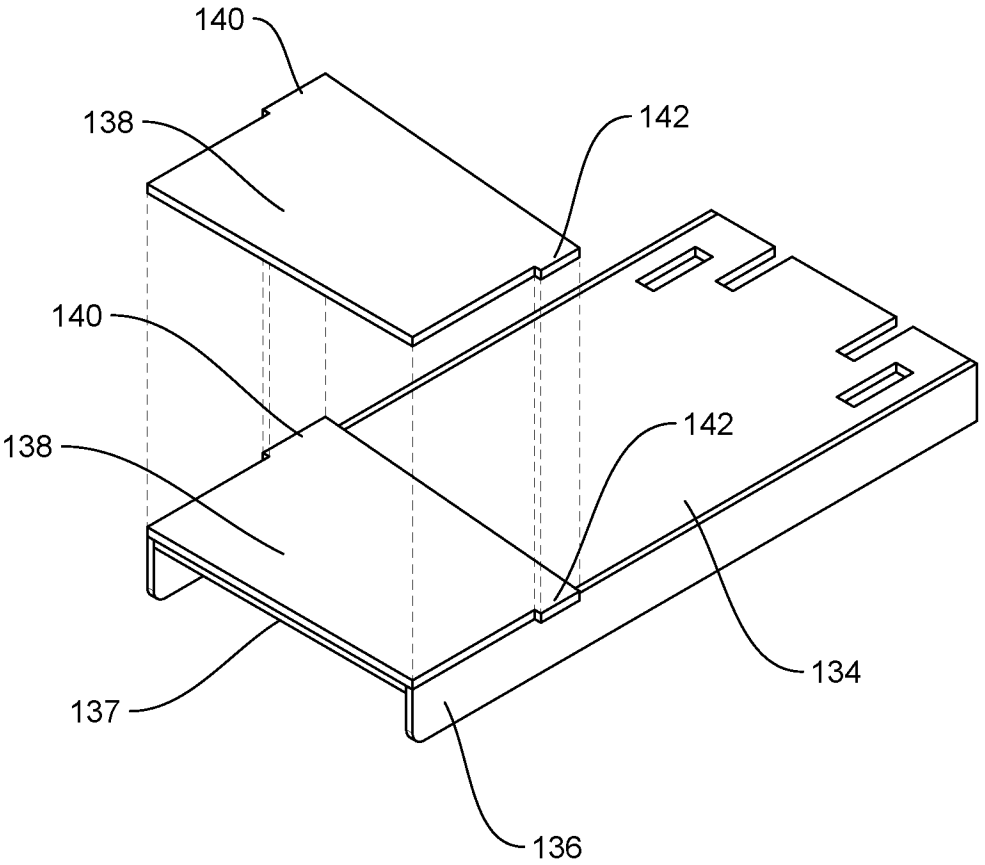
FIG. 9 is a partially exploded view of the trim tab, in combination with a guide plate, wherein FIG. 9 conceptually shows where said guide plate is coupled.

FIG. 9 is a partially exploded view of the trim tab 134, in combination with a guide plate 138, wherein FIG. 9 conceptually shows where said guide plate i138 s coupled on a trim tab 134. The Figure also shows the guiding tabs 140/142, and sidewall 136.

Figure 10A:
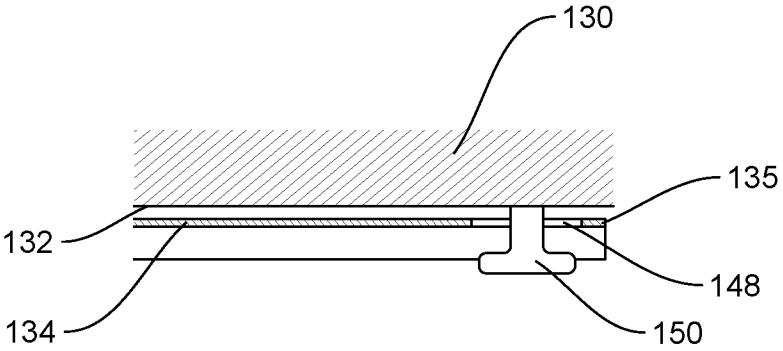
FIG. 10A shows a cross-sectional view of a trim tab showing the engagement of a fluid hinge through the fluid hinge aperture.
Figure 10B:
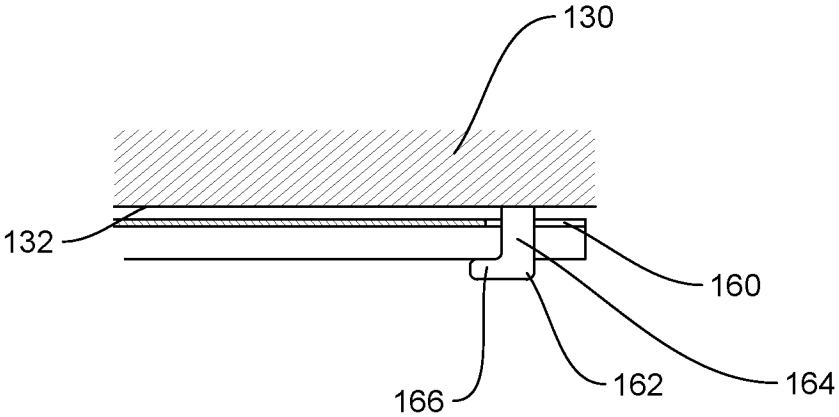
FIG. 10B shows a cross-sectional view of the forward trim tab safety catch through the forward trim tab safety catch aperture.

FIG. 10A shows a cross-sectional view of a trim tab 134 showing the engagement of a fluid hinge bracket 150 through the fluid hinge aperture 140 under the bottom surface 132 of the hull 130 of the watercraft. As may be seen, the fluid hinge bracket 150 is a smaller diameter then the aperture 148 for which it engages. Therefore, a risk may exist for situations when the boat is reversing for the front portion of the trim tab 134 to disengage with the fluid hinge bracket and fall down. Therefore, a safety catch tab 162 is used. FIG. 10B shows a cross-sectional view of the forward trim tab safety catch 162 through the forward trim tab safety catch aperture 160. The safety catch is comprised of the forward trim tab safety catch leg 164 and the forward safety catch tab 166. The forward safety catch tab 166 operates as a shelf during reverse to prevent the forward portion of the trim tab from descending too low and falling off.

An embodiment of the invention provides a system for a transom-mount trim tab system with a fluid hinge 1000. The system includes a trim tab 134 having a planar surface, and guiding tabs 140/142 coupled to the trim tab 134, wherein the guiding tabs 140/142 extend outward toward a port side and a starboard side. The trim tab 134 has a forward section 135 located under a hull 130 of a watercraft and an rear portion 137 extending aft of a transom 126, whereby mounting means may engage with the trim tab to raise and lower the trim tab. The mounting means including a pair of mounting brackets 111/113, each with a mounting plate 114/116, and a vertical leg 110/112, and a safety catch tab 118/120. The mounting brackets 111/113 are configurable for variable mounting, wherein the vertical leg 110/112 of the mounting bracket includes a vertical leg upper portion 172 and a vertical leg bottom portion 174, the vertical leg bottom portion 174 is in a vertical orientation, and the vertical leg upper portion 172 is configurable to be angulated relative to a transom 126 of a watercraft. The upper portion of the vertical leg 172 and the mounting bracket 176 have a configurable angle there-between 144/146, wherein the angle 144/146 may be enlarged or reduced resulting in an adjustment relative to a curvature in the transom 126 of a watercraft. The trim guiding tabs 140/142 configured to engage with the vertical legs 110/112 of the mounting bracket 111/113, wherein the guiding tabs 140/142 are located forward of the vertical legs 110/112 of the mounting brackets 111/113.

The guiding tabs 140/142 are coupled to the trim tab 134 through use of a guiding plate 138, wherein the guiding tabs 140/142 may be configured as a part of the guiding plate 138 and located towards a bow section of the guiding plate 138, and the guiding plate 138 is affixed to the trim tab 134. The vertical legs 110/112 of the mounting brackets 111/113 are in physical communication with the guiding tabs 140/142, but are not physically coupled. "Physical communication" refers to the ability to physically influence, such as pushing or pulling, without a fixed connection. A cross-section of the vertical legs 110 includes a rounded forward portion 170 of the vertical legs 110/112 for enhanced hydrodynamic efficiency. The trim tab 134 may include at least one aperture 148 for a T-shaped fluid hinge bracket 150, and at least one aperture 160 for an L-shaped trim tab safety catch 162, wherein both the at least one aperture 148 for a T-shaped fluid hinge bracket 150 and at least one aperture 160 for an L-shaped trim tab safety catch 162 are located toward a bow section of the trim tab 135.

In an embodiment of the invention, a method for configuring a system for a transom-mount trim tab system with a fluid hinge 1000 is provided. The method includes using a flat board (not shown) with borders of the flat board mirroring a set of dimensions of a trim tab 134 to be mounted, lining the flat board (not shown) up in a bow to stern orientation in the approximate final mounting location of the trim tab 134 to be mounted, temporarily mounting the board under a bottom surface 132 of a hull 130 of a watercraft, wherein the temporary mounting is accomplished through use of an expanding stand (not shown) to press the board (not shown) against the bottom surface 132 under the hull 130 of a watercraft, marking an outline of a transom boundary 128 of the transom 126 on to the flat board to obtain a template for a guide plate 138. The method further includes providing a trim tab system 1000, of the type recited above, configuring the guide plate 138 to dimensions of the template, wherein the guiding tabs 140/142 are placed at a location just under the boundary of the transom 128 to thereby guide the trim tabs 134 when engaged with the pair of vertical legs 110/112 of the mounting bracket 111/113, configuring the upper portion of the vertical legs 172 to match an angulation of the transom 126, the lower legs 174 remaining vertical, configuring the mounting plate 114/116/176 of the mounting bracket 111/113 the angulation of the transom 126, and mounting the trim tab system 1000 to the transom 126 of the watercraft. While some elements do not explicitly appear in the figures (such as the board and expanding stand), these pieces are known to a person of skill in the art, such as a plywood board, and a typical jack stand used in boat storage, and the instructions herein would be clear as to what the process is. Further, while the drawings represent the physical attributes of the system, the instructions herein coupled with the reference to the physical components would also be understood to a person of skill in the art.

The configuration of the upper portion of the vertical legs 172 and the configuration of the mounting plate 176 includes configuring metal components therein 172/176/174, wherein the configuration is accomplished through at least one of warping the metal, bending the metal, and welding the metal to required angulation.

While there has been shown and described above the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

I claim:

1. A system for a transom-mount trim tab system with a fluid hinge, comprising:

a trim tab having a planar surface;

guiding tabs coupled to said trim tab, wherein said guiding tabs extend outward toward a port side and a starboard side;

said trim tab with a forward section located under a hull of said watercraft and an rear portion extending aft of a transom, whereby mounting means may engage with said trim tab to raise and lower said trim tab;

said mounting means including a pair of mounting brackets, each with a mounting plate, and a vertical leg, and a safety catch tab;

said mounting brackets are configurable for variable mounting, wherein said vertical leg of said mounting bracket includes a vertical leg upper portion and a vertical leg bottom portion, said vertical leg bottom portion in a vertical orientation, and said vertical leg upper portion is configurable to be angulated relative to a transom of a watercraft;

said upper portion of said vertical leg and said mounting bracket having a configurable angle there-between, wherein said angle may be enlarged or reduced resulting in an adjustment relative to a curvature in said transom of a watercraft; and said trim guiding tabs configured to engage with said vertical legs of said mounting bracket, wherein said guiding tabs are located forward of said vertical legs of said mounting brackets.

2. The system for a transom-mount trim tab system with a fluid hinge as recited in claim 1, wherein said guiding tabs are coupled to said trim tab through use of a guiding plate, wherein said guiding tabs are configured as a part of said guiding plate and located towards a bow section of said guiding plate, and said guiding plate is affixed to said trim tab.

3. The system for a transom-mount trim tab system with a fluid hinge as recited in claim 1, wherein said vertical legs of said mounting brackets are in physical communication with said guiding tabs, but are not physically coupled.

4. The system for a transom-mount trim tab system with a fluid hinge as recited in claim 3, wherein a cross-section of said vertical legs included a rounded forward portion of said vertical legs for enhanced hydrodynamic efficiency.

5. The system for a transom-mount trim tab system with a fluid hinge, as recited in claim 1, further comprising:

said trim tab including at least one aperture for a T-shaped fluid hinge bracket, and at least one aperture for an L-shaped trim tab safety catch, wherein both said at least one aperture for a T-shaped fluid hinge bracket and at least one aperture for an L-shaped trim tab safety catch are located toward a bow section of said trim tab.

6. A method for configuring a system for a transom-mount trim tab system with a fluid hinge, comprising:

using a flat board with borders of said flat board mirroring a set of dimensions of a trim tab to be mounted;

lining said flat board up in a bow to stern orientation in the approximate final mounting location of said trim tab to be mounted;

temporarily mounting said under a bottom surface of a hull of a watercraft, wherein said temporary mounting is accomplished through use of an expanding stand to press said board against said bottom surface under said hull of a watercraft;

marking an outline of a transom boundary of said transom on to said flat board to obtain a template for a guide plate providing a trim tab system including:

(i) a trim tab having a planar surface;

(ii) guiding tabs coupled to said trim tab, wherein said guiding tabs extend outward toward a port side and a starboard side;

(iii) said trim tab with a forward section located under a hull of said watercraft and an rear portion extending aft of a transom, whereby mounting means may engage with said trim tab to raise and lower said trim tab;

(iv) said mounting means including a pair of mounting brackets, each with a mounting plate, and a vertical leg, and a safety catch tab;

(v) said mounting brackets are configurable for variable mounting, wherein said vertical leg of said mounting bracket includes a vertical leg upper portion and a vertical leg bottom portion, said vertical leg bottom portion in a vertical orientation, and said vertical leg upper portion is configurable to be angulated relative to a transom of a watercraft;

(vi) said upper portion of said vertical leg and said mounting bracket having a configurable angle therebetween, wherein said angle may be enlarged or reduced resulting in an adjustment relative to a curvature in said transom of a watercraft; and (vii) said trim guiding tabs configured to engage with said vertical legs of said mounting bracket, wherein said trim tabs are located forward of said vertical legs of said mounting brackets;

configuring said guide plate to dimensions of said template, wherein said guiding tabs are placed at a location just under said boundary of said transom to thereby guide said trim tabs when engaged with said pair of vertical legs of said mounting bracket;

configuring said upper portion of said vertical legs to match an angulation of said transom, said lower legs remaining vertical;

configuring said mounting plate of said mounting bracket said angulation of said transom; and mounting said trim tab system to said transom of said watercraft.

7. The method for configuring a system for a transom-mount trim tab system with a fluid hinge, as recited in claim 6, wherein said configuration of said upper portion of said vertical legs and said configuration of said mounting plate includes configuring metal components therein, wherein said configuration is accomplished through at least one of warping said metal, bending said metal, and welding said metal to required angulation.

* * * * *